US006752098B2

(12) United States Patent
Skulnick

(10) Patent No.: US 6,752,098 B2
(45) Date of Patent: Jun. 22, 2004

(54) RECESSED LINE HOLDER FOR A BOAT FENDER

(75) Inventor: Steven Skulnick, Ramona, CA (US)

(73) Assignee: The Skulnick Family Trust, Ramona, CA (US)

( * ) Notice: Subject to any disclaimer, the term of this patent is extended or adjusted under 35 U.S.C. 154(b) by 0 days.

(21) Appl. No.: 10/178,593

(22) Filed: Jun. 25, 2002

(65) Prior Publication Data

US 2002/0162494 A1 Nov. 7, 2002

Related U.S. Application Data

(63) Continuation-in-part of application No. 09/802,981, filed on Mar. 12, 2001, now Pat. No. 6,435,122.

(51) Int. Cl.[7] ..... B63B 59/02
(52) U.S. Cl. ..... 114/219
(58) Field of Search ..... 114/219; D12/168; 405/212, 215

(56) References Cited

U.S. PATENT DOCUMENTS 3,183,875 A * 5/1965 Russell ..... 114/219
D217,310 S 4/1970 Duckett et al.
4,252,073 A 2/1981 Hartung et al.
4,565,147 A 1/1986 Bortolotti
5,013,272 A 5/1991 Watkins
5,016,554 A 5/1991 Harris, Jr. et al.
5,018,471 A 5/1991 Stevens
5,273,473 A 12/1993 Allen
5,562,364 A 10/1996 Darder-Alomar
5,715,769 A 2/1998 Mills
6,196,150 B1 3/2001 Fondacaro
D452,466 S 12/2001 Skulnick
6,435,122 B1 * 8/2002 Skulnick ..... 114/219

FOREIGN PATENT DOCUMENTS

GB 1098847 * 1/1968

* cited by examiner

*Primary Examiner*—Sherman Basinger
(74) *Attorney, Agent, or Firm*—Liniak, Berenato & White

(57) ABSTRACT

A boat fender with a recessed line holder to permit an individual to adjust the positioning of the boat fender to a desired length. The recessed line holder is flush with the outer surface of the boat fender to create a smooth outer surface. The recessed line holder has a bridge under which a rope is inserted through a passage. The rope may then be tied off or secured to another fender.

18 Claims, 4 Drawing Sheets

RECESSED LINE HOLDER FOR A BOAT FENDER

This application is a continuation-in-part of U.S. application Ser. No. 09/802,981 filed Mar. 12, 2001, now U.S. Pat. No. 6,435,122.

BACKGROUND OF THE INVENTION

1. Field of the Invention

The present invention relates to a recessed line holder for a boat fender. More specifically, the recessed line holder provides a passage through which a line is fed. Once the line has been fed through the line holder, the line is secured to position the boat fender at a desired location.

2. Background Art

When a boat is being docked, it is common to position several fenders along the side of the boat so that the fenders are positioned between the side of the hull of the boat and the dock to cushion any impact. Quite commonly these fenders are elongate cylindrical members that are connected at one or both ends to a rope that in turn is tied or attached by tying the rope around the railing of the boat. The ropes used to secure the fender are usually fed through either a grommet or other hook on the fender.

Various structures have been used as boat fenders, especially for absorbing impact and protecting the boat following docking contact. Such bumpers or fenders commonly assume the configuration of cylinders or rollers and are commonly suspended by lines along the sides of the boat hull. The fenders are principally designed to absorb impact although they have some braking action from frictional contact of the elastomeric material with the docking structure.

Any device or system that is used on a boat should also be reliable, easily stowable (if it is to be stowed) and also convenient to mount or dismount (or connect or disconnect) if that is part of the function of the device. Further, nautical devices should be easy to use and function as intended.

In some instances the grommet or passage, through which the rope is inserted, is located on a tab or periphery surface connected to the fender itself. This tab or periphery surface is subject to potential damage while in storage or actual use of the fender. Since the tab is formed outside the perimeter of the main fender, it may not be manufactured to withstand higher stresses involved with the fender's usage.

Still other fenders have grooves circumventing the perimeter of the structure wherein a rope is wrapped around the fender and a piling of a dock or bulkhead. However, these fenders may become dislodged from the ropes that bind the fender to the dock or bulkhead. Thus, the fender may fall into the water. Similarly, these fenders are difficult to properly position, especially when considering changing tides. These fenders also pose a potential problem with docks that do not have pilings in which to secure such devices.

There is a need for an improved boat fender that provides a means for reliably securing the fender in a position to protect the boat. The fender must also facilitate repositioning in accordance with changing conditions.

SUMMARY OF THE INVENTION

The present invention provides an improved boat fender that reliable protects a boat from damage by a docking structure and centers on the pole or piling of the docking structure.

It is an object of the present invention to provide a boat fender with an outer surface designed to enhance its centering ability with respect to a pole or piling. It is also the object of this invention to prevent slipping out of position and away from the pole or piling while moored to a dock by using a recessed line holder to secure the fender to a line.

The invention achieves the above-stated objectives by providing a bumper structure for a floating vessel, containing an elongated resilient member having a first end and a second end along a longitudinal direction. The resilient member having an outer surface defining a circumference circumscribing the longitudinal direction and at least one recessed line holder positioned on at least one of the circumference circumscribing the longitudinal direction, the first end, and the second end. The recessed line holder is substantially contained within said circumference.

The recessed line holder includes a nook formed from the outer surface depressing inward toward a geometric center of the bumper structure, wherein a first side and a second side are formed along the nook and a bridge connecting the first and second sides such that a passage is formed between a bottom surface of the bridge and the nook.

It is yet another object of the invention to provide a boat fender or bumper that is either inflatable or non-inflatable.

It is yet another object of the invention to provide a boat fender or bumper that may be made of at least one of PVC (e.g., 30 oz., 42 oz.), rubber, foam, or any suitable elastomeric or resilient material.

These and other objectives will be achieved with reference to the following drawings and associated description.

DETAILED DESCRIPTION OF THE PREFERRED EMBODIMENTS

With reference to the attached drawings, the present invention will now be described in the environment of usage for the boat fender of this invention.

Figure 1:
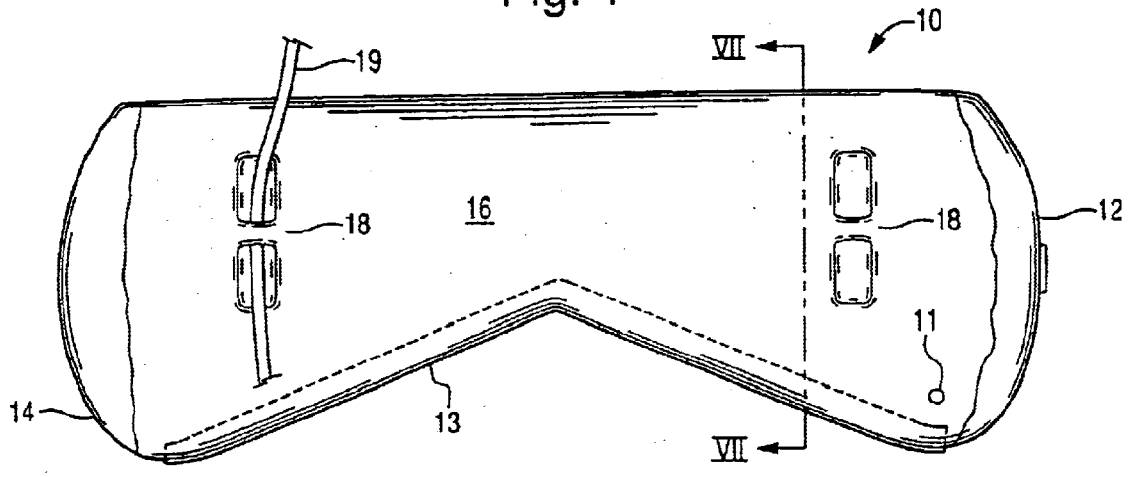
FIG. 1 is a top view of the boat fender according to the preferred embodiment of the present invention.

FIG. 1 shows a preferred embodiment of this invention whereby the boat bumper or fender 10 comprises a first end 12, and a second end 14 with a main body portion 16 extending along a longitudinal length from the first end 12 to the second end 14. Recessed line guides 18 are located in the main body portion 16 along a surface to facilitate the use of a line 19 in securing the boat fender 10 to a pole or boat (not shown). A plurality of recessed line guides 18 may be formed anywhere on the boat fender 10. In the preferred embodiment as best seen in FIG. 1, the recessed line guides

18 are located on a top surface of the main body portion 16. However, it is important to note that one skilled in the art may similarly place the recessed line guides on bottom surface or the back surface of the main body portion 16. This would allow the boat fender 10 to be suspended in any number of positions to best protect the boat from damage.

The boat fender shown is FIG. 1 is an irregular shape, it should be appreciated that the shape of the boat fender is not an essential element of the invention. The boat fender may be completely circular, or any other shape desired by an individual. Thus the shape as illustrated in the Figures should not be considered as limiting when viewing the invention as a whole.

Even further, the recessed line guides may also be formed on the first end 12 and second end 14 as well, or may be formed to suspend the fender in either a vertical or horizontal position. Recessed line guides formed on the first and second ends 12, 14 would allow the boat fender to hang suspended with the longitudinal length in the vertical direction.

Figure 2:
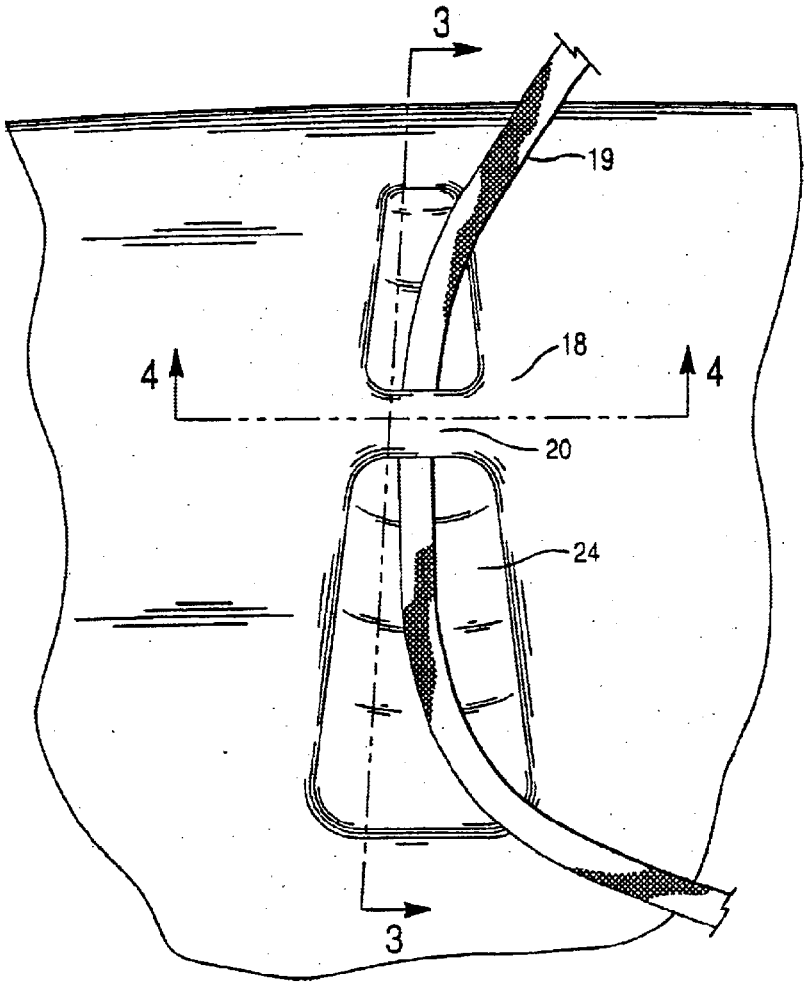
FIG. 2 is a partial view of the recessed line holder of the boat fender of FIG. 1.
Figure 3:
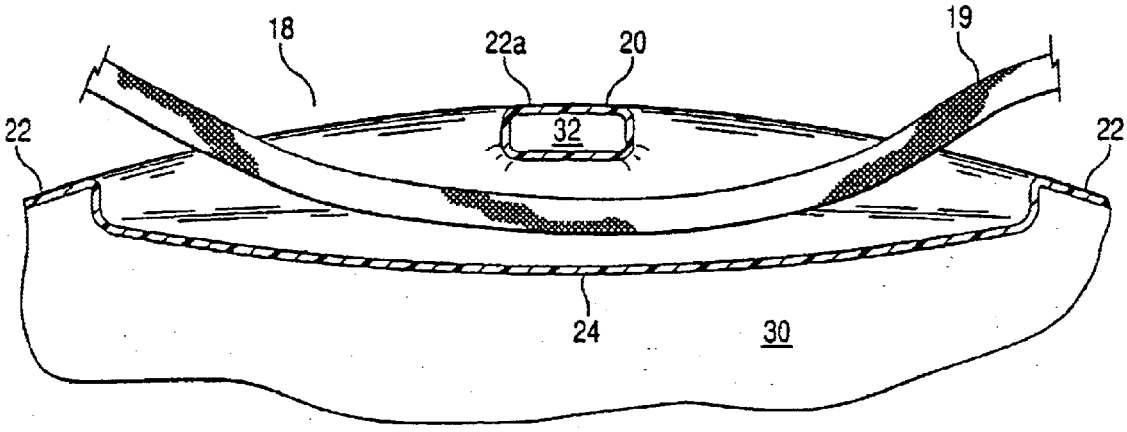
FIG. 3 is a profile view along line 3—3 of FIG. 2 showing the long axis of a passageway formed between the bridge and the nook.
Figure 4:
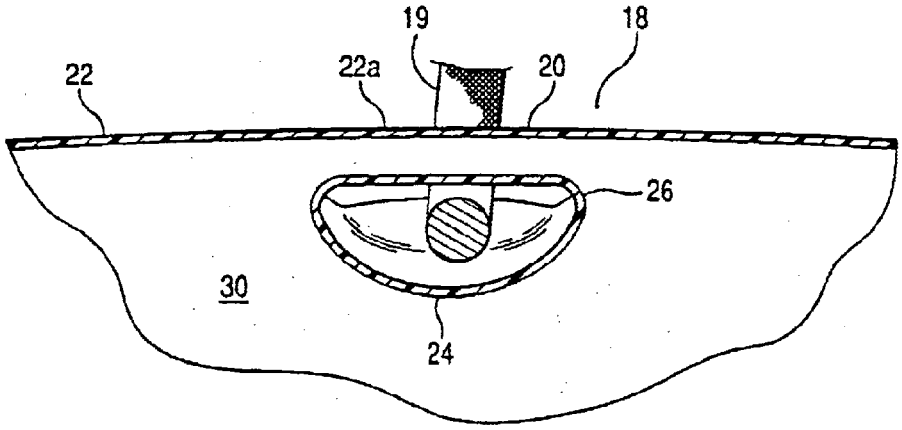
FIG. 4 is a profile view along line 4—4 of FIG. 2 showing the short axis of a passageway formed between the bridge and the nook.

The recessed line guides or holders 18 will now be described with reference to FIGS. 2–4. FIGS. 2–4 show a line or rope 19 engaging the recessed line guide 18 of FIG. 1. The line 19 is passed under a bridge 20 formed from the main body portion 16. The recessed line guide 18 begins where the outer surface 22 of the main body portion 16 depresses inward toward the geometric center of the main body portion 16 to form a nook 24 in the bottom of the recessed line guide 18. The nook 24 is defined by a concave bottom surface. The nook 24 is made from the same material as that of the boat fender 10. Centered approximately in the middle and above the nook is the bridge 20. The bridge 20 is also formed from the same material as that of the entire boat fender 10. The top surface 22*a* of the bridge 20 is flush with the outer surface 22 of the main body portion 16. This allows the entire boat fender 10 to have a smooth external surface. This arrangement minimizes the necessary space for the boat fender 10 to be stored when not in use and also limits extraneous appendages that may be damaged over time.

The boat fender 10 is formed of materials adequate to endure the rigors and hazards associated with docking structures. The boat fender 10 is preferably a resilient plastic substance; however, any material that exhibits the qualities necessary to withstand the rigors associated with use of the boat fender 10 may also be employed, such as elastomeric materials. The boat fender 10 may be provided with at least one friction abutment member 13 having a higher durability than a material forming the outer contour of the boat fender 10. The boat fender 10 may be inflatable through a valve 11 positioned on body of the boat fender 10. The exact positioning of the valve is not critical to the invention. Those skilled in the art can determine the positioning of the valve depending on specific needs.

If the boat fender 10 is inflatable, they the boat fender 10 has an interior chamber 30 as seen in FIGS. 3 and 4. In this instance, the bridge 20 also has a chamber 32 that is openly connected with the interior chamber 30 of the boat fender so that fluid can freely flow therebetween. When the boat fender is inflated, air (or other fluid) fills the interior chamber 30 and then flows into the chamber 32 of the bridge. When the boat fender 10 is deflated, the air is forced out of the interior chamber 30 and chamber 32 to reduce the profile of the boat fender 10.

Figure 5:
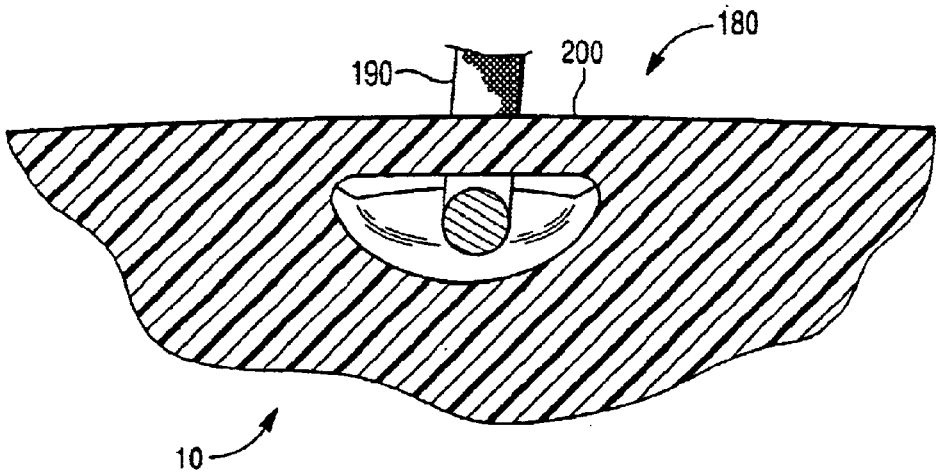
FIG. 5 is a profile view of an alternate embodiment showing the recessed line holder and the boat fender as a solid object.

In an alternative embodiment shown in FIG. 5, the boat fender 10 is made from an elastomeric material. In this instance, the interior of the boat fender 10 is filled with the material. The bridge 200 is constructed from the same material as that of the boat fender 10. A rope 190 is then capable of being inserted through the recessed line holder 180 as shown in the figure.

Figure 6:
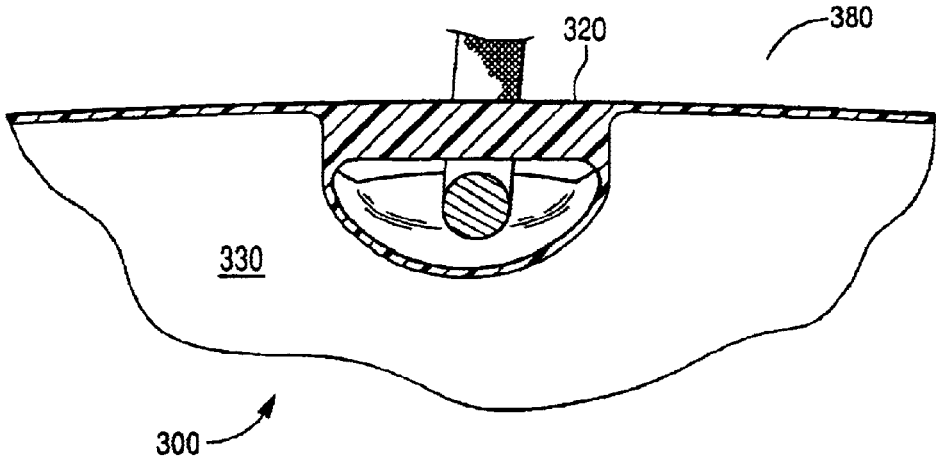
FIG. 6 is a profile view of yet another embodiment showing the bridge as a solid structure in combination with a hollow, inflatable boat fender.
Figure 7A:
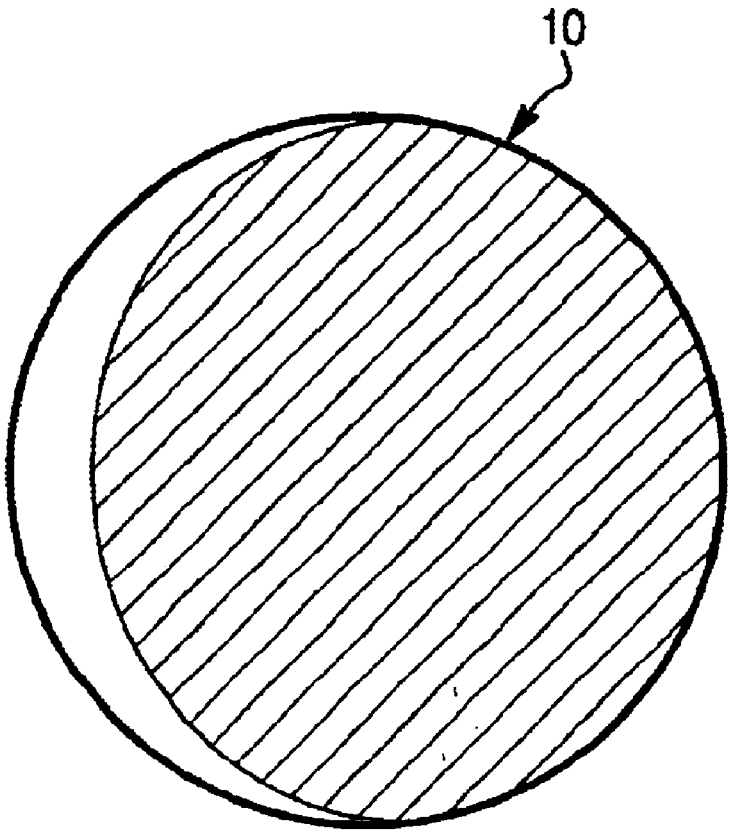
FIG. 7*a* illustrates a cross sectional view of the boat fender having a circular shape.

In FIG. 6, yet another embodiment of the present invention is illustrated. Here, the boat fender 300 has a recessed line holder 380 that includes a bridge 320 formed as a solid mass. The boat fender 300 has a hollow chamber 300 in order to allow the fender 300 making the fender inflatable. The bridge 320 is formed from the same material as that of the fender 300.

Although the present invention has been shown and described with references to several preferred embodiments, it will be understood that various changes in form and detail may be made therein without departing from the spirit and scope of the present invention. For example, the material of the present invention may be varied and selected according to the environment and usage envisioned for the particular boat and its environment. The fender may be inflatable or non-inflatable. In addition, the specific materials used to form the boat fender 10 may be selected from any material having sufficient resiliency and deformability, such as PVC (e.g., 30 oz. core mill or 42 oz. core mill), rubber, plastic, foam, etc. The recessed line holder may be constructed as a solid bridge, i.e., without a chamber, while the boat fender is made with an interior chamber thus rendering the boat fender as inflatable.

What is claimed is:

1. A bumper structure for a floating vessel, comprising:

an elongated resilient member having a first end and a second end along a longitudinal direction; said resilient member having an outer surface defining a circumference circumscribing said longitudinal direction; and at least one recessed line holder positioned on and recessed into at least one of said circumference circumscribing said longitudinal direction, said first end, and said second end, said at least on recessed line holder forming a passageway through which a retention line may pass to secure said bumper structure, wherein said recessed line holder defines a concave bottom surface facing said at least one of said circumference, said first end and said second end, wherein said longitudinal direction defines a central axis of said resilient member extending between said first and second ends, said passageway and said central axis being mutually exclusive.

2. The bumper structure according to claim 1, wherein said recessed line holder further comprising:

a nook forming a concave bottom surface depressing inward toward a geometric center of said bumper structure, wherein a first side and a second side are formed along said nook; and a bridge connecting said first and second sides such that a passage is formed between said concave bottom surface and said bridge.

3. The bumper structure according to claim 2, wherein said bridge has a top surface that is substantially flush with said outer surface.

4. The bumper structure according to claim 2, wherein said bridge is hollow and is in fluid connection with an interior chamber of said bumper structure.

5. The bumper structure according to claim 1, wherein said bridge is substantially solid.

6. The bumper structure according to claim 5, wherein said bumper structure has an interior chamber that is substantially hollow.

7. The bumper structure according to claim 5 wherein said bumper structure is substantially solid.

8. The bumper structure according to claim 1, wherein outer surface defines a circular shape in cross-section.

9. The bumper structure according to claim 1, wherein said resilient member is made from at least one material selected from the group consisting of polyvinyl chloride, rubber, plastic, and foam.

10. The bumper structure according to claim 1, wherein said resilient member is inflatable.

11. The bumper structure according to claim 10, wherein at least one valve is located on said outer surface of said bumper structure to regulate the flow of a fluid into an interior chamber of said bumper structure.

12. The bumper structure according to claim 1, further comprising at least one frictional abutment member disposed on said outer contour, said frictional abutment member having a higher durability than a material forming said outer contour.

13. A recessed line holder for a bumper structure to allow a retention line to secure said bumper structure, comprising:

an outer surface formed from a resilient member;

a nook recessed into said outer surface to form a concave surface, wherein a first side and a second side are formed along said nook from said outer surface; and a bridge connecting said first and second sides such that a passage is formed between a bottom surface of said bridge and said nook, wherein said bridge of said recessed line holder is to be disposed flush with an outer circumference of said bumper structure, and wherein said concave surface faces said bridge, and wherein said outer circumference circumscribes a central axis extending between a first end and a second end of the bumper structure, said passage and said central axis being mutually exclusive.

14. The recessed line holder according to claim 13, wherein said resilient member is made from at least one material selected from the group consisting of polyvinyl chloride, rubber, plastic, and foam.

15. The recessed line holder according to claim 13, wherein said bridge has a top surface that is substantially flush with said outer surface.

16. The recessed line holder according to claim 13, wherein said bridge is hollow.

17. The recessed line holder according to claim 13, wherein said bridge is substantially solid.

18. The recessed line holder according to claim 13, wherein said recessed line holder is secured to a bumper structure for a floating vessel.

* * * * *